US007236079B2

(12) United States Patent
Lin

(10) Patent No.: US 7,236,079 B2
(45) Date of Patent: Jun. 26, 2007

(54) TRANSFORMER BOBBIN FOR PREVENTING EXCITATION PEAK VOLTAGE INSULATION DAMAGE

(76) Inventor: Jiuan Lin, No. 4, Lane 130, Nan-Kang Rd., Sec. 3, Taipei (TW)

( * ) Notice: Subject to any disclaimer, the term of this patent is extended or adjusted under 35 U.S.C. 154(b) by 37 days.

(21) Appl. No.: 11/187,329

(22) Filed: Jul. 23, 2005

(65) Prior Publication Data

US 2007/0018769 A1 Jan. 25, 2007

(51) Int. Cl.
*H01F 27/30* (2006.01)

(52) U.S. Cl. ..... 336/198; 336/208; 336/192

(58) Field of Classification Search ..... 336/208, 336/198, 192

See application file for complete search history.

(56) References Cited

U.S. PATENT DOCUMENTS 4,151,500 A * 4/1979 Malerba et al. ..... 336/185
4,274,136 A * 6/1981 Onodera et al. ..... 363/68
4,352,079 A * 9/1982 Mueller et al. ..... 336/65
5,332,989 A * 7/1994 Ching ..... 336/208
7,116,201 B2 * 10/2006 Fushimi ..... 336/198
2003/0094535 A1 * 5/2003 Schmidt ..... 242/603

* cited by examiner

*Primary Examiner*—Anh Mai
(74) *Attorney, Agent, or Firm*—Pro-Techtor Int'l Services

(57) ABSTRACT

A transformer bobbin for preventing excitation peak voltage insulation damage that is applicable for application in cold cathode tube resonant inverters or backlight modules, wherein such transformers must frequently endure relatively high voltages, and, moreover, are light, slim and small. The present invention avoids the need to update existing iron cores and manufacturing process by using inclined wire storage grooves defined on top ends of partition walls, which provide for enameled wire to pass thereover, thereby increasing insulation effectiveness between layers of windings, and achieving objective of a transformer being able to endure a relatively high voltage.

3 Claims, 2 Drawing Sheets

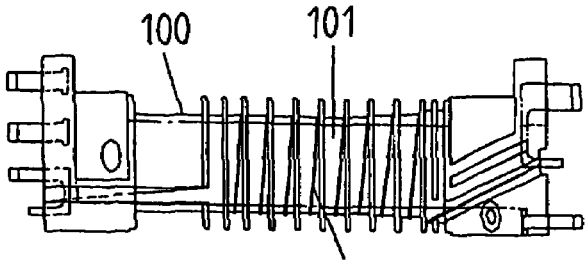
FIG.1
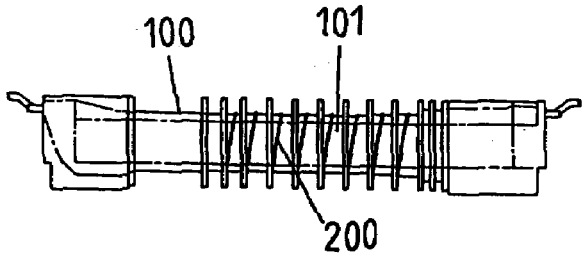
FIG.2
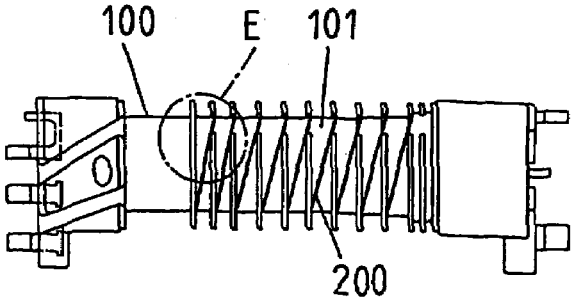
FIG.3
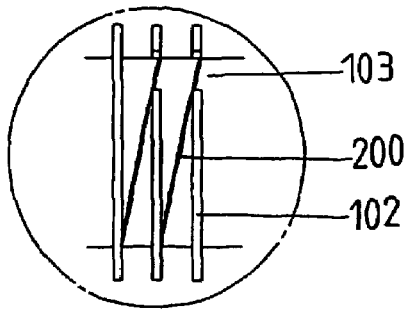
E
FIG.3~1

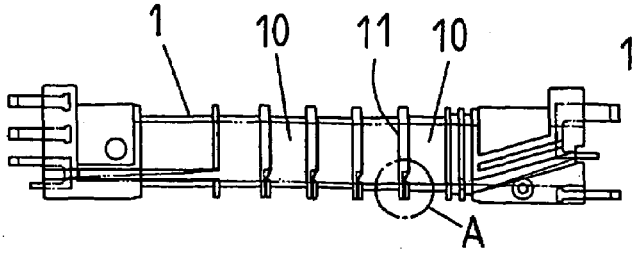
FIG.4
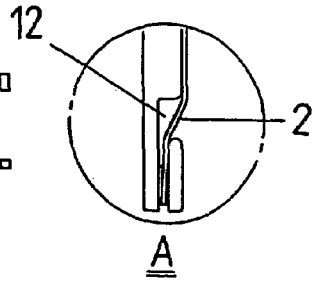
FIG.4~1
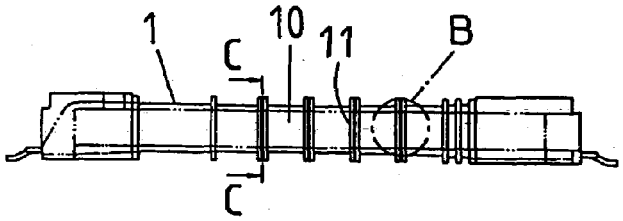
FIG.5
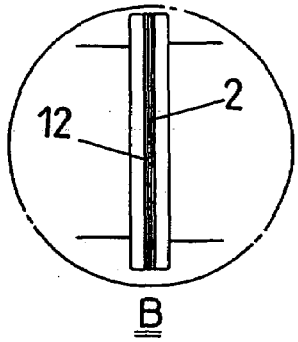
FIG.5~1
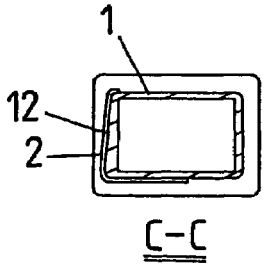
FIG.5~2
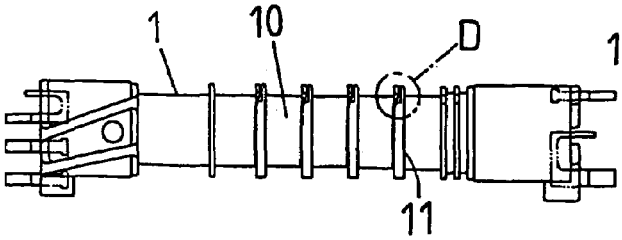
FIG.6
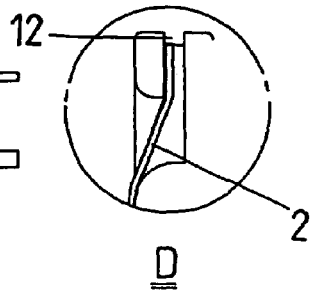
FIG.6~1

TRANSFORMER BOBBIN FOR PREVENTING EXCITATION PEAK VOLTAGE INSULATION DAMAGE

BACKGROUND OF THE INVENTION (a) Field of the Invention

The present invention relates to a transformer bobbin for application in a resonant backlight circuit, and more particularly to a transformer bobbin which uses inclined wire storage grooves defined on top ends of partition walls that provide for enameled wire to pass thereover, thereby increasing insulation effectiveness between layers of windings, and achieving objective of a transformer being able to endure a relatively high voltage.

(b) Description of the Prior Art

A conventional resonant backlight circuit uses a transformer bobbin as depicted in FIGS. 1, 2 and 3, wherein a gap 103 is defined on each partition wall 102 insulating winding grooves 101 of a transformer bobbin 100 (see FIG. 3-1), thereby enabling enameled wire 200 to pass through each of the gaps 103 to the next adjacent winding groove 101. However, the wire 200 is first wound in the winding groove 101 in front to a definite height, and then passed through the gap 103 to commence winding round a bottom portion of the next adjacent winding groove 101, which results in a large voltage difference having to be endured because the wire 200 has passed from a high position through the gap 103 to a low position of the next adjacent winding groove 101. Furthermore, indefinite factors of the windings frequently cause inadequate insulation between layers of windings and burning, resulting in serious aftereffects.

SUMMARY OF THE INVENTION

A primary objective of the present invention is to provide a backlight module output transformer bobbin that uses inclined wire storage grooves defined on top ends of partition walls, which provide for enameled wire to pass thereover, thereby increasing insulation effectiveness between layers of windings, and achieving objective of a transformer being able to endure a relatively high voltage.

To enable a further understanding of said objectives and the technological methods of the invention herein, brief description of the drawings is provided below followed by detailed description of the preferred embodiments.

BRIEF DESCRIPTION OF THE DRAWINGS

FIG. 1 shows a top view of a conventional transformer bobbin for an inverter.

FIG. 2 shows a front view of the conventional transformer bobbin for an inverter.

FIG. 3 shows a bottom view of the conventional transformer bobbin for an inverter.

FIG. 3-1 shows a partial enlarged view of FIG. 3 depicting the conventional transformer bobbin for an inverter.

FIG. 4 shows a top view according to the present invention.

FIG. 4-1 shows a partial enlarged view of FIG. 4 according to the present invention.

FIG. 5 shows a front view according to the present invention.

FIG. 5-1 shows a partial enlarged view of FIG. 5 according to the present invention.

FIG. 5-2 shows a cross-sectional view of FIG. 5 according to the present invention.

FIG. 6 shows a bottom view according to the present invention.

FIG. 6-1 shows a partial enlarged view of FIG. 6 according to the present invention.

DETAILED DESCRIPTION OF THE PREFERRED EMBODIMENTS

Referring to FIGS. 4, 5 and 6, which show a plurality of partition walls 11 configured on a transformer bobbin 1, to form a winding frame, separating winding grooves 10 thereon. An inclined wire storage groove 12 is defined on one side edge or two side edges of a top end of each of the partition walls 11 (see FIGS. 5-1, 5-2), which provide for an enameled wire 2 to smoothly pass thereover to a bottom portion of the next adjacent winding groove 10, thereby curtailing a connecting step, and reducing time required to systematically complete a set of windings within each winding groove 10. A resonant backlight circuit using the transformer bobbin 1 utilizes the inclined wire storage grooves 12 respectively defined on top ends of the partition walls 11 to provide for the enameled wire 2 to pass thereover, thereby increasing insulation effectiveness between layers of windings, and achieving objective of a transformer being able to endure a relatively high voltage.

The inclined wire storage groove 12 on a top end of each of the partition walls 11 provides for the enameled wire 2 to pass thereover, furnishing excellent insulation. Furthermore, the inclined wire storage grooves 12 are able to ensure the enameled wire 2 smoothly passes over to a bottom portion of the next adjacent winding groove 10 to commence winding therein, thereby greatly increasing voltage endurance between layers of windings.

In conclusion, the present invention primarily uses the inclined wire storage groove 12 on the top end of each of the partition walls 11 to provide for the enameled wire 2 to pass thereover. Inclination of each of the inclined wire storage grooves 12 is able to ensure the enameled wire 2 smoothly passes over to a bottom portion of the next adjacent winding groove 10 to commence winding therein, thereby increasing insulation effectiveness between layers of windings, and achieving the objective of a transformer being able to endure a relatively high voltage.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A transformer bobbin for improved resistance to excitation peak voltage insulation damage, comprising a winding frame having at least one side and a plurality of partition walls of insulating material, configured on a transformer bobbin separating winding grooves thereon, each of said partition walls having a first side, a second side, an outer edge connecting said first and second sides, each of said partition walls having and a double-wall wire transition groove defined on said outer edge thereof, each said transition groove having a single-wall recessed edge entry on the first side and a single-wall recessed edge exit on the second side of each of the partition walls;

wherein an enameled wire may smoothly pass thereover from one winding groove to the next adjacent winding groove, the adjacent winding grooves being everywhere separated by at least one insulating wall.

2. The transformer bobbin for improved resistance to excitation peak voltage insulation damage according to claim 1, wherein the transition groove of the partition wall is defined on the outer edge of one side of the winding frame.

3. The transformer bobbin for improved resistance to excitation peak voltage insulation damage according to claim 1, wherein the transition groove of the partition wall is defined on the outer edges of two sides of the winding frame.

* * * * *